US009525243B1

(12) United States Patent
Yuan et al.

(10) Patent No.: US 9,525,243 B1
(45) Date of Patent: Dec. 20, 2016

(54) ELECTRICAL CONNECTOR

(71) Applicant: Cheng Uei Precision Industry Co., Ltd., New Taipei (TW)

(72) Inventors: Sheng-Tsung Yuan, New Taipei (TW); Sheng-Nan Yu, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/001,198

(22) Filed: Jan. 19, 2016

(51) Int. Cl.

| | |
|---|---|
| ***H01R 13/648*** | (2006.01) |
| ***H01R 13/6585*** | (2011.01) |
| ***H01R 24/60*** | (2011.01) |
| ***H01R 13/6581*** | (2011.01) |
| *H01R 107/00* | (2006.01) |

(52) U.S. Cl.
CPC ..... *H01R 13/6585* (2013.01); *H01R 13/6581* (2013.01); *H01R 24/60* (2013.01); *H01R 2107/00* (2013.01)

(58) Field of Classification Search
CPC ..... H01R 13/6587; H01R 23/668
USPC ..... 439/607.28, 607.07, 607.11
See application file for complete search history.

(56) References Cited

U.S. PATENT DOCUMENTS

| | | | | |
|---|---|---|---|---|
| 8,851,927 | B2 * | 10/2014 | Hsu | H01R 12/724 439/607.11 |
| 9,281,642 | B1 * | 3/2016 | Tseng | H01R 24/60 |
| 9,281,643 | B1 * | 3/2016 | Tseng | H01R 13/518 |
| 9,306,336 | B2 * | 4/2016 | Chang | H01R 13/6471 |
| 9,331,433 | B2 * | 5/2016 | Ueda | H01R 13/6581 |

* cited by examiner

*Primary Examiner* — Phuong Dinh
(74) *Attorney, Agent, or Firm* — Cheng-Ju Chiang

(57) ABSTRACT

An electrical connector includes an insulating housing, a middle shielding plate integrally molded to the insulating housing, and a plurality of terminals received in the insulating housing. The insulating housing has a base portion and a tongue portion. A front section of the tongue portion has two fixing portions. The middle shielding plate has a base plate, an extending plate, and two bending portions formed at two opposite sides of a front end of the extending plate. The two bending portions are respectively molded in the two fixing portions. Outer side surfaces of the two bending portions are exposed outside from two opposite sides of the two fixing portions. A thickness of each of the bending portions is greater than a thickness of the extending plate.

13 Claims, 10 Drawing Sheets

ELECTRICAL CONNECTOR

BACKGROUND OF THE INVENTION

1. Field of the Invention

The present invention generally relates to an electrical connector, and more particularly to an electrical connector capable of improving anti-abrasion performance.

2. The Related Art

In order to unify electrical connectors of different equipments for improving universalities of the electrical connectors, USB (Universal Serial Bus) connectors are the most popular interfaces of current computers. The USB connectors support plug-and-play external buses. The USB connectors are used for connecting with multiple kinds of peripheral devices, including loudspeakers, telephones, game controllers, printers, tablet devices, cameras and so on. With the popularization of the USB connectors, except for data transmissions, the current USB connectors are widely used in a charging field.

However, a USB 2.0 connector and a USB 3.0 connector respectively provide an output power of 2.5 W and an output power of 4.5 W. Though the USB 2.0 connector and the USB 3.0 connector are capable of conforming to charging requirements of small portable devices or tablet devices in a earlier period, in the process of charging, a wait time is still longer, and with intelligent telephones and tablets being manufactured larger and larger, regarding to a product which need consume a larger power, a power output capability of the USB connector is more or less deficient.

With the development of the electronic industries, in order to make the USB connectors applied in different power supply devices more popularly, and solve a drawback that the USB 2.0 connector need be distinguished an obverse surface from a reverse surface to be inserted, an innovative USB type C connector is emerged.

In order to make the USB connector realize a normal insertion and a reverse insertion, a row of conductive terminals are increased to the USB connector that will cause a series of problems, for example, an intensity of the USB connector is weaker, an insulating housing of the USB connector is easily scrapped to cause a damage after multiple insertions and withdrawals that affects anti-abrasion performance of the USB connector. As a result, an electrical conduction characteristic between the butting connector and the electrical connector is worse.

SUMMARY OF THE INVENTION

An object of the present invention is to provide an electrical connector. The electrical connector includes an insulating housing, a middle shielding plate and a plurality of terminals. The insulating housing has a base portion, and a tongue portion protruded frontward from a front surface of the base portion. A front section of the tongue portion has a main portion, and two fixing portions protruded outward from two opposite sides of the main portion. The middle shielding plate is integrally molded in the insulating housing. The middle shielding plate has a base plate, an extending plate extended frontward from a front edge of the base plate, and two bending portions formed at two opposite sides of a front end of the extending plate. The extending plate is molded in the tongue portion. Two opposite side surfaces of the extending plate are exposed outside from two opposite sides of the main portion of the tongue portion. The two bending portions are respectively molded in the two fixing portions. Outer side surfaces of the two bending portions are exposed outside from two opposite sides of the two fixing portions. A thickness of each of the bending portions is greater than a thickness of the extending plate. The terminals are received in the insulating housing.

As described above, the middle shielding plate is integrally molded in the insulating housing, the two bending portions are respectively molded in the two fixing portions, the outer side surfaces of the two bending portions are exposed outside from the two opposite sides of the two fixing portions, the thickness of each of the bending portions is greater than the thickness of the extending plate, so after a butting connector is interconnected with the electrical connector, the scraping area between the butting connector and the electrical connector is mostly located at the outer side surfaces of the two bending portions, so that scraped plastic of the tongue portion is decreased to improve anti-abrasion performance of the electrical connector in the process of the butting connector being interconnected with the electrical connector. As a result, a better electrical conduction characteristic between the butting connector and the electrical connector is ensured.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
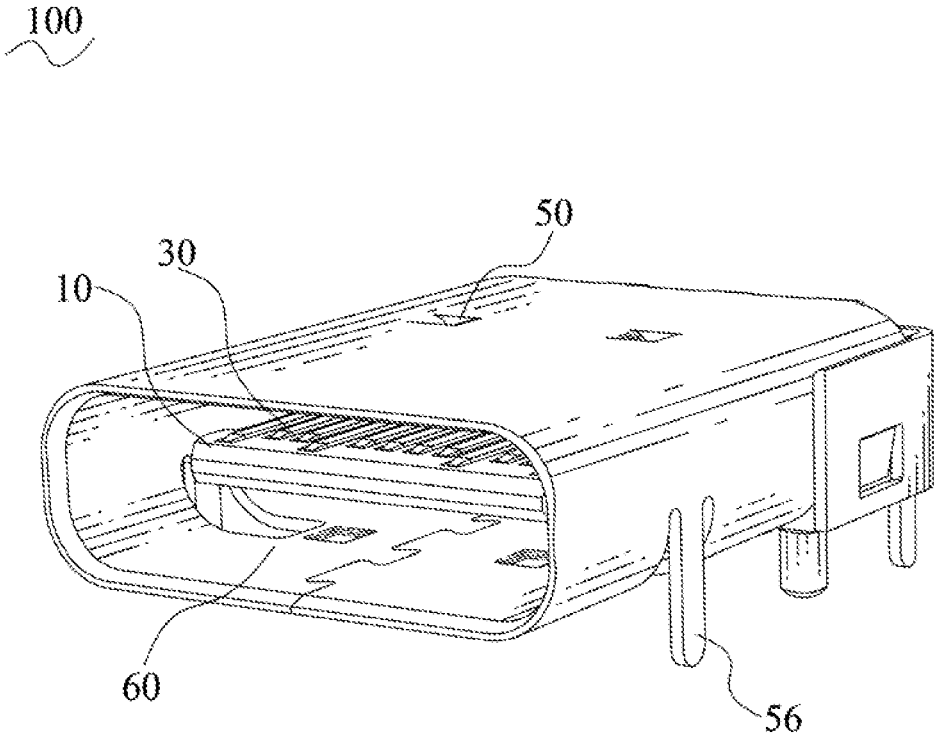
FIG. 1 is a perspective view of an electrical connector in accordance with an embodiment of the present invention.
Figure 2:
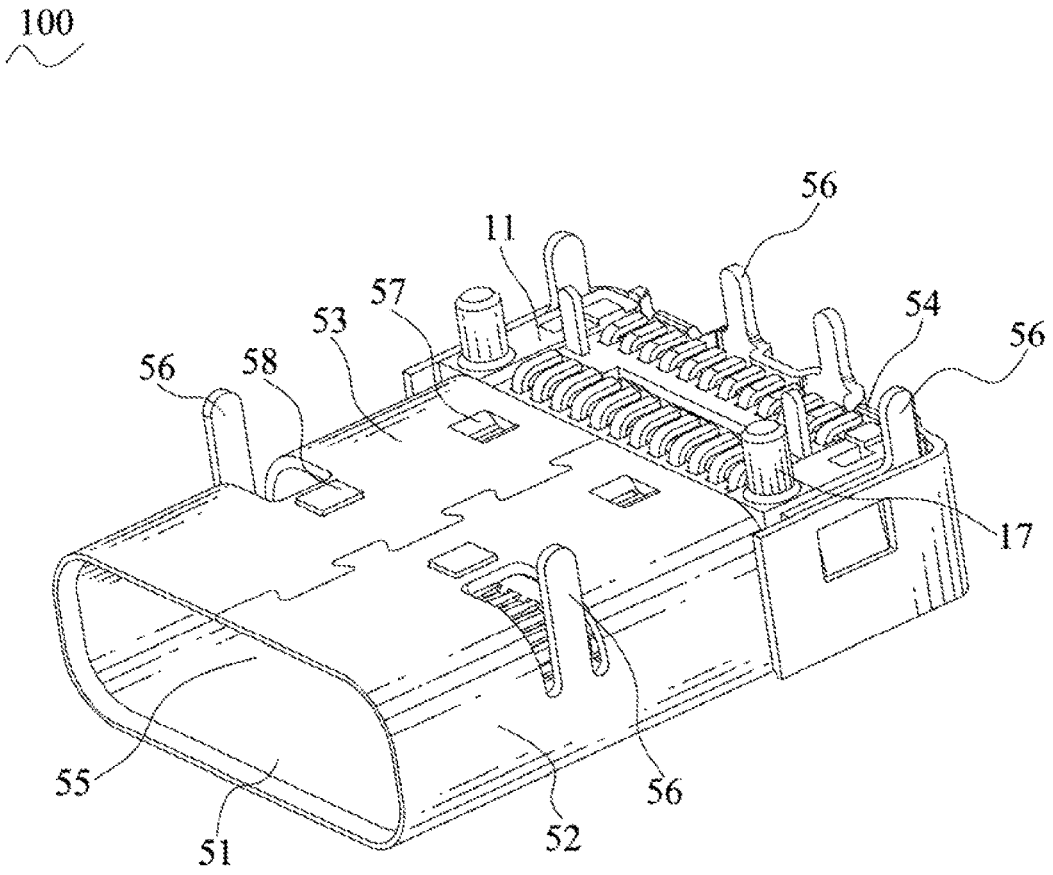
FIG. 2 is another perspective view of the electrical connector of FIG. 1.
Figure 3:
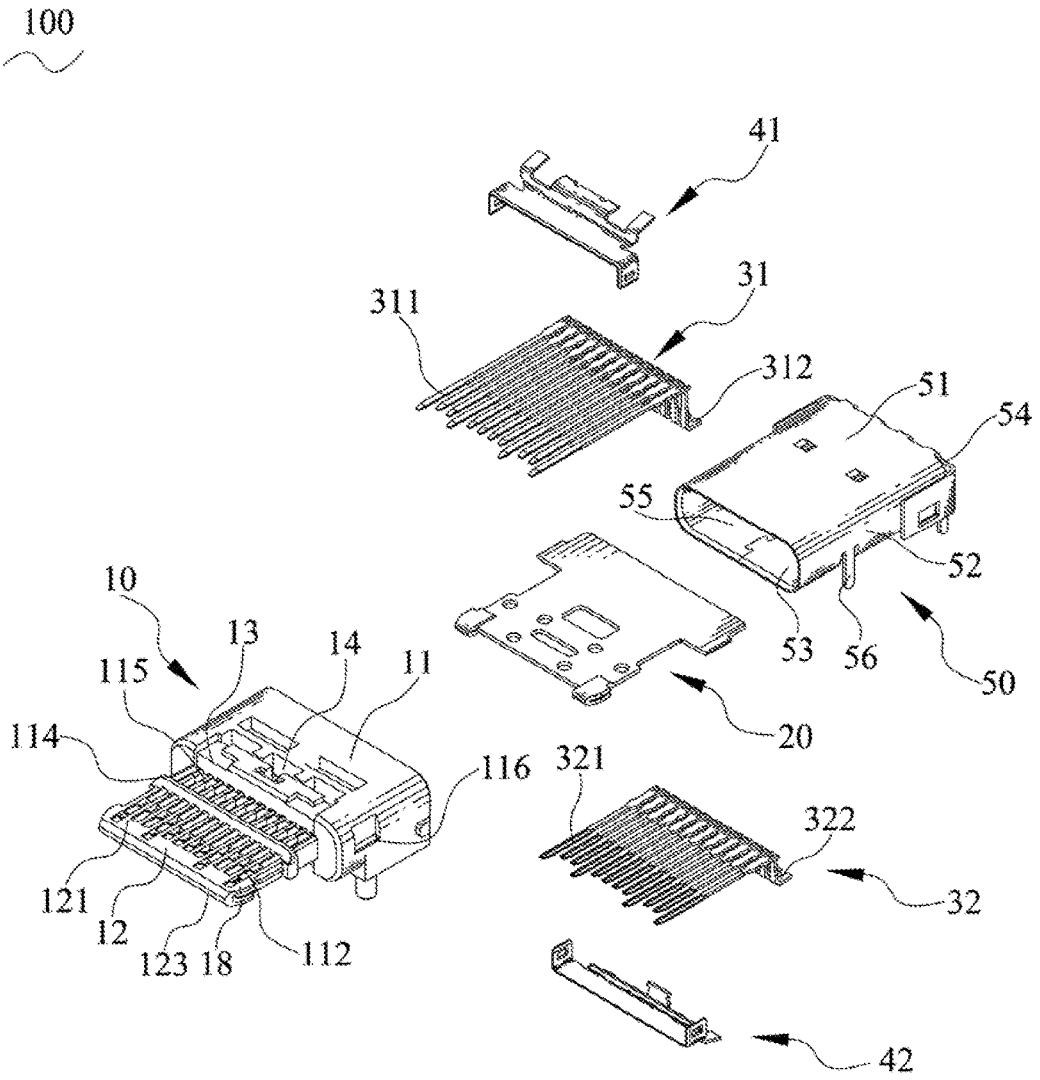
FIG. 3 is an exploded view of the electrical connector of FIG. 1.
Figure 4:
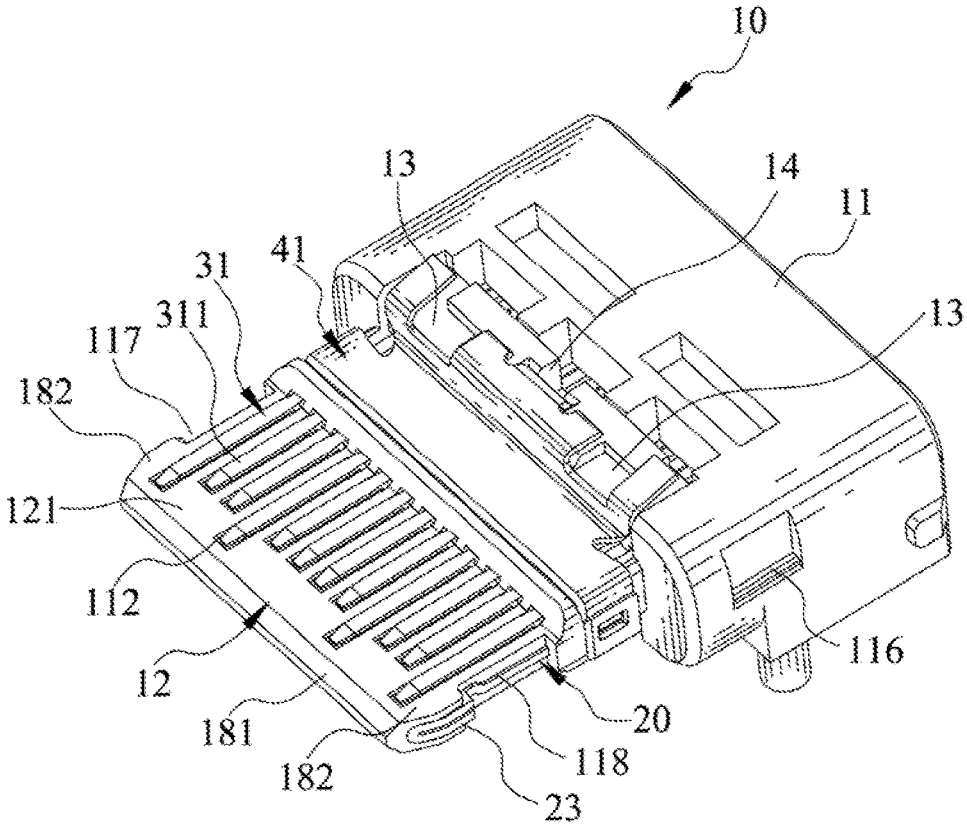
FIG. 4 is a partially perspective view of the electrical connector in accordance with the embodiment of the present invention, wherein a shielding shell is omitted.

With reference to FIG. 1, FIG. 3 and FIG. 4, an electrical connector 100 in accordance with an embodiment of the present invention is shown. The electrical connector 100 mounted to a circuit board (not shown), includes an insulating housing 10, a middle shielding plate 20, a plurality of terminals 30, an inner shielding shell assembly 40 and an outer shielding shell 50.

Figure 5:
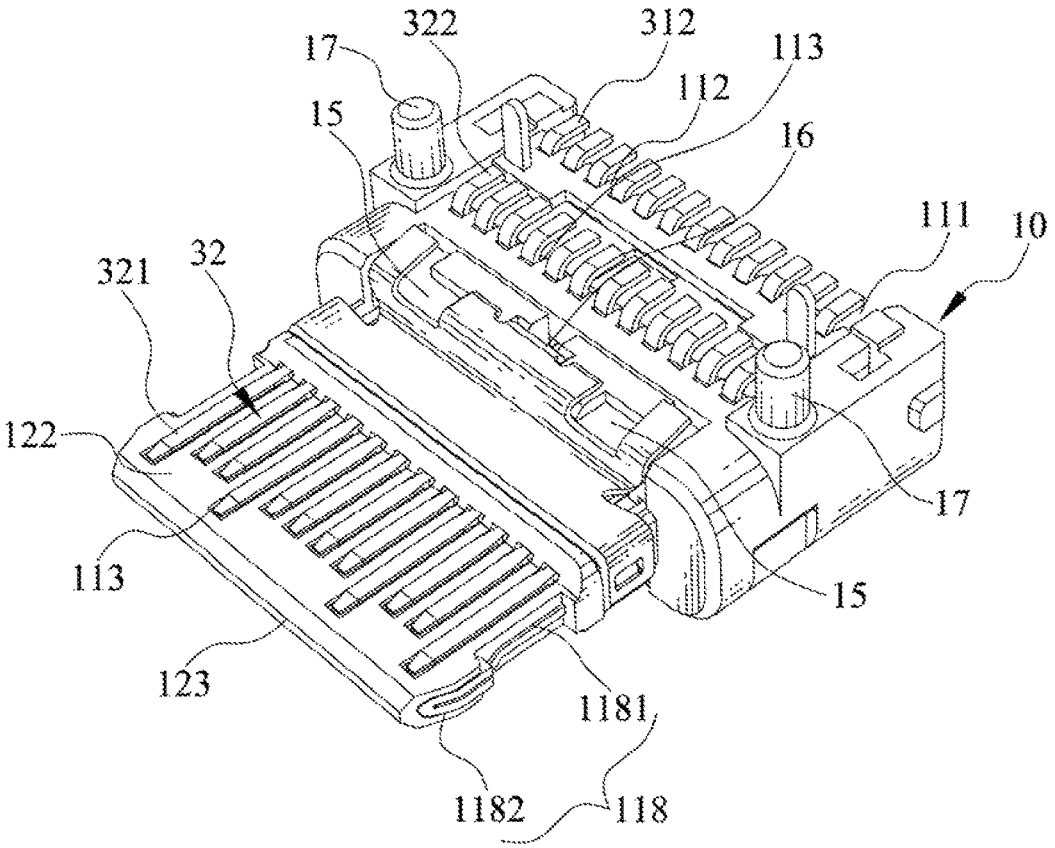
FIG. 5 is another partially perspective view of the electrical connector of FIG. 4.
Figure 6:
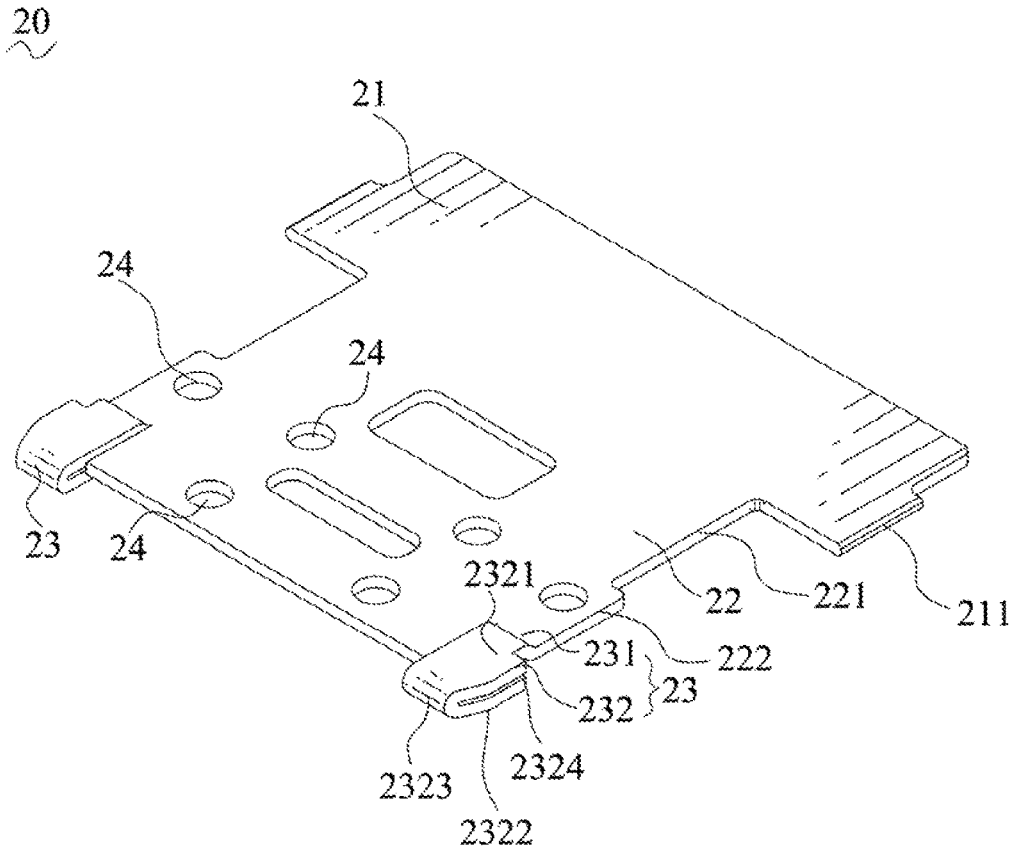
FIG. 6 is a perspective view of a middle shielding plate of the electrical connector in accordance with the embodiment of the present invention.
Figure 7:
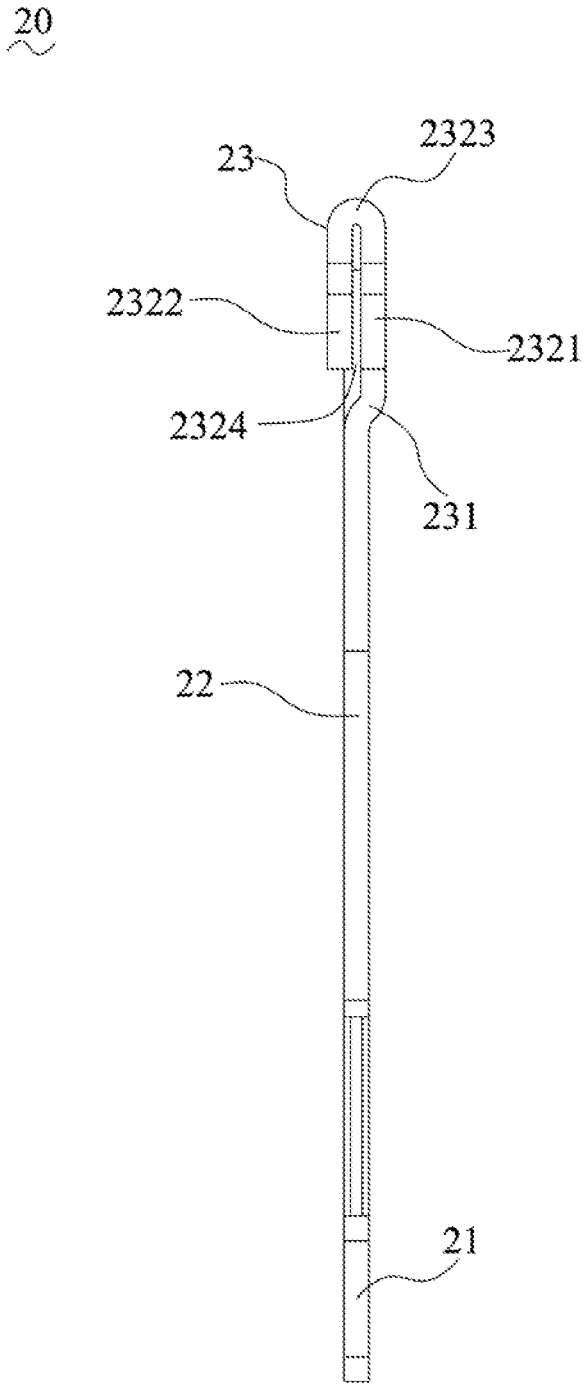
FIG. 7 is a lateral view of the middle shielding plate of the electrical connector of FIG. 6.
Figure 8:
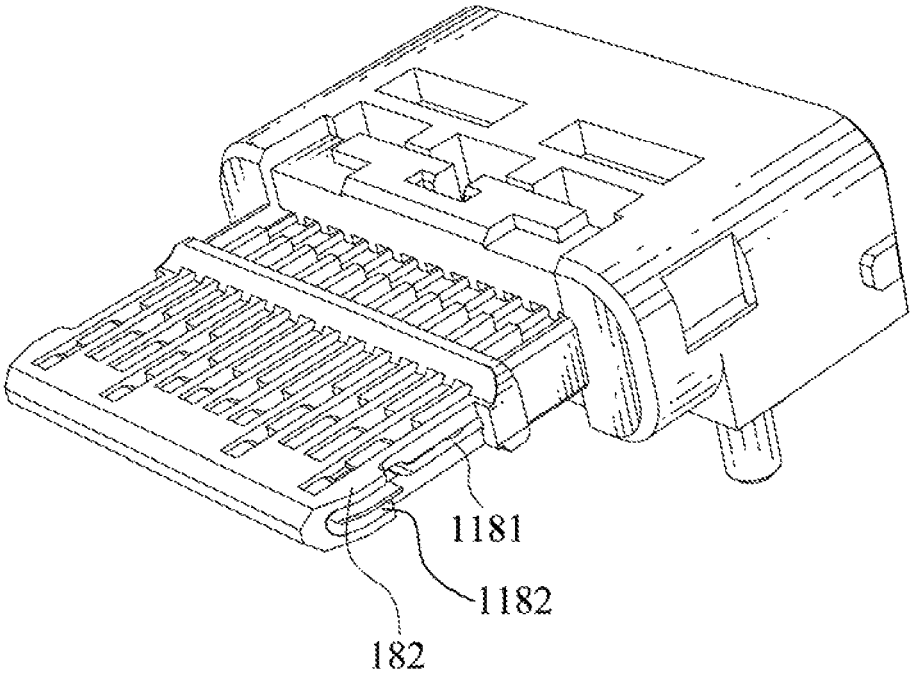
FIG. 8 is a partially perspective view showing an insulating housing and a middle shielding plate of the electrical connector in accordance with the embodiment of the present invention.
Figure 9:
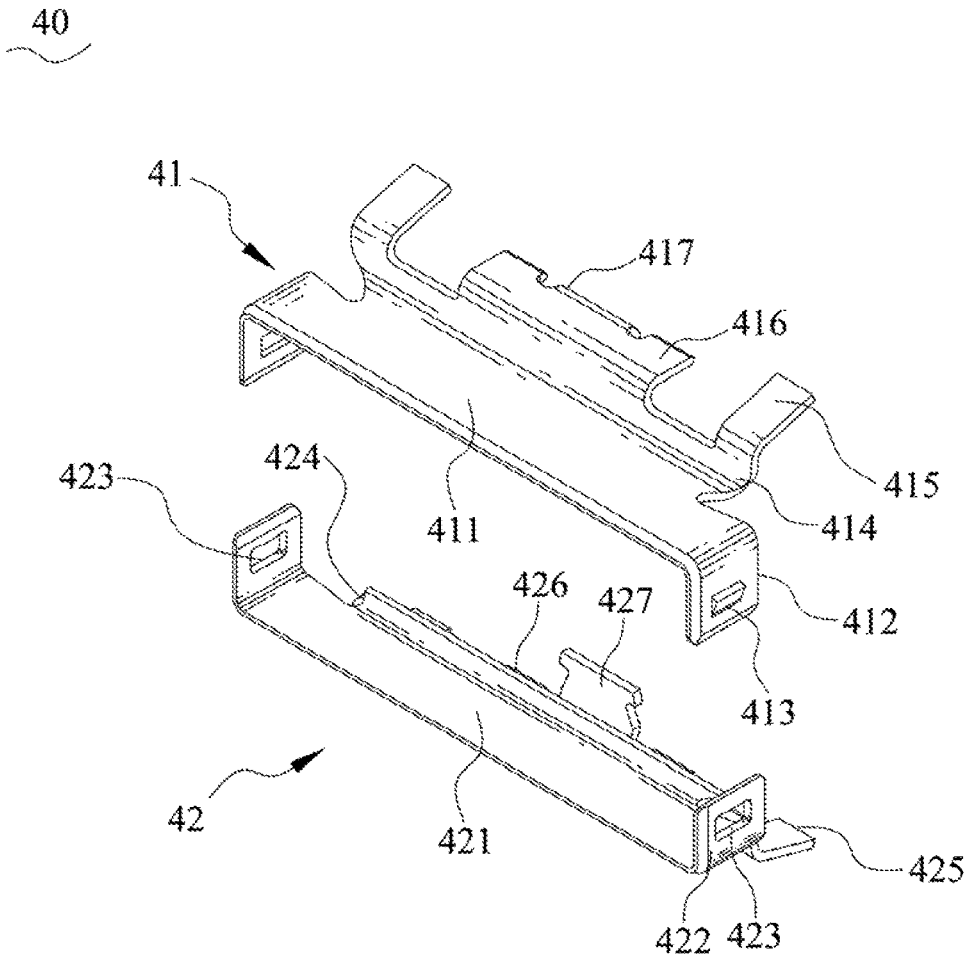
FIG. 9 is an exploded view of an inner shielding shell assembly of the electrical connector in accordance with the embodiment of the present invention.
Figure 10:
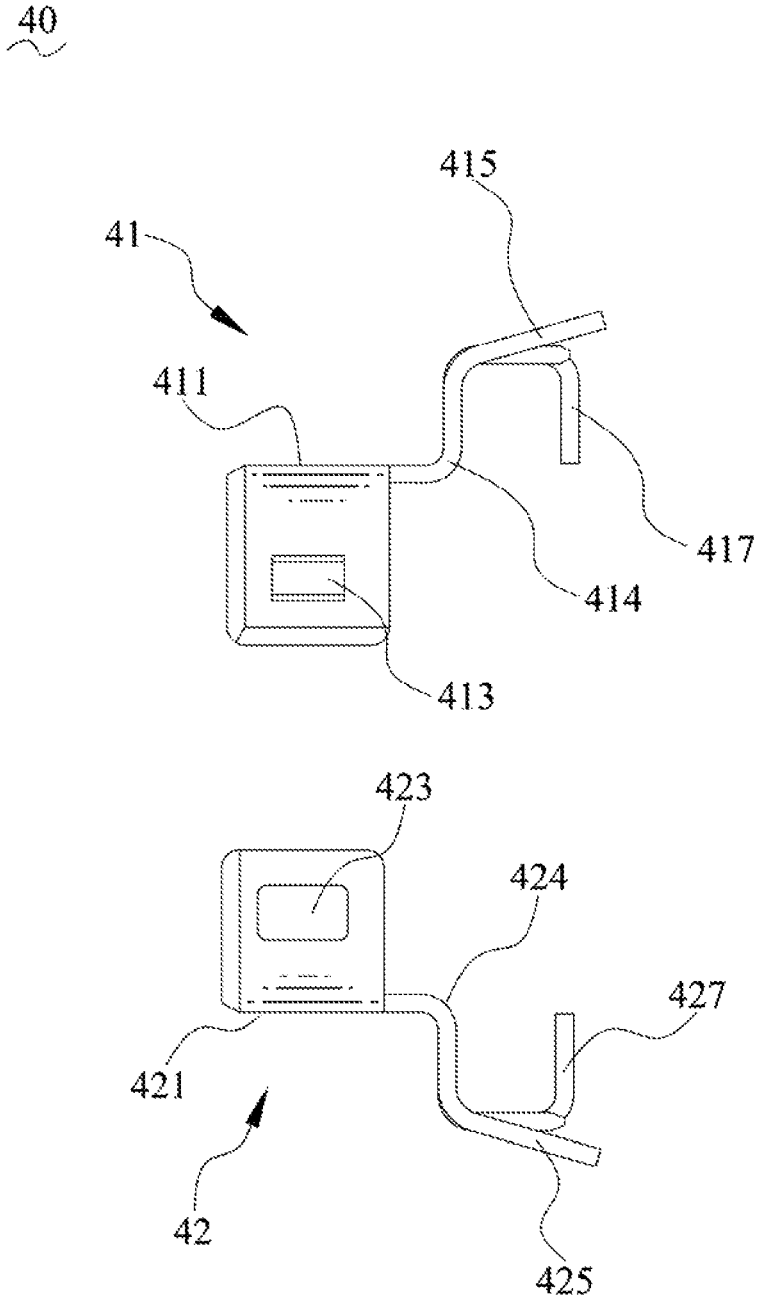
FIG. 10 is another exploded view of the inner shielding shell assembly of the electrical connector of FIG. 9.

Referring to FIG. 3 to FIG. 5, the insulating housing 10 has a base portion 11, and a tongue portion 12 protruded frontward from a middle of a front surface of the base portion 11. The base portion 11 defines an assembling opening 111 penetrating through a rear of a bottom surface and a rear surface of the base portion 11. The base portion 11 defines a plurality of first terminal grooves 112 penetrating through a top surface of the tongue portion 12 and an upper portion of the front wall of the assembling opening 111. The first terminal grooves 112 are arranged transversely. The base portion 11 defines a plurality of second terminal grooves 113 penetrating through a bottom surface of the tongue portion 12 and a lower portion of the front wall of the assembling opening 111. The second terminal grooves 113 are arranged transversely. A rear of a periphery of the tongue portion 12 is connected with a ring-shaped blocking rib 114. The blocking rib 114 is spaced from the front surface of the base portion 11 to form a receiving groove 115 between the blocking rib 114 and the base portion 11. Two opposite sides of the base portion 11 define two perforations 116 communicated with the assembling opening 111.

The base portion 11 defines two first recesses 13 penetrating through two opposite sides of a top surface and the front surface of the base portion 11. A middle of the top surface of the base portion 11 is concaved downward to form a first locking groove 14 located between the two first recesses 13. The base portion 11 defines two second recesses 15 penetrating through two opposite sides of the bottom surface and the front surface of the base portion 11. A middle of the bottom surface of the base portion 11 is concaved upward to form a second locking groove 16 located between the two second recesses 15. Two opposite sides of the bottom surface of the base portion 11 protrudes downward to form two cylindrical locating pillars 17. A front end of the tongue portion 12 located in front of the blocking rib 114 is defined as a front section 18. The front section 18 of the tongue portion 12 has a top face 121, a bottom face 122 opposite to the top face 121, and a front face 123 connected between the top face 121 and the bottom face 122. A junction between the top face 121 and the front face 123 and a junction between the bottom face 122 and the front face 123 are chamfered.

Referring to FIG. 3, FIG. 4, FIG. 5 and FIG. 8, the front section 18 of the tongue portion 12 has a main portion 181, and two fixing portions 182 protruded outward from two opposite sides of the main portion 181. The two fixing portions 182 are spaced from two opposite sides of the blocking rib 114 to form two locating grooves 117. Each of the locating grooves 117 is located between one of the fixing portions 182 and the blocking rib 114. The insulating housing 10 defines a fixing slot 118 penetrating through two opposite side surfaces of the front section 18 of the tongue portion 12, and middles of a rear surface of the tongue portion 12 and a front wall of the assembling opening 111. The fixing slot 118 includes a first fixing slot 1181 penetrating through two opposite side surfaces of the main portion 181 of the tongue portion 12, and middles of the rear surface of the tongue portion 12 and the front wall of the assembling opening 111, and two lying narrow U-shaped second fixing slots 1182 recessed inward from outer surfaces of the two fixing portions 182. Each of the second fixing slots 1182 is wider than the first fixing slot 1181.

Referring to FIG. 3 to FIG. 8, the middle shielding plate 20 is stamped by a metal plate. The middle shielding plate 20 has a rectangular base plate 21, an extending plate 22 extended frontward from a middle of a front edge of the base plate 21, and two lying narrow U-shaped bending portions 23 formed at two opposite sides of a front end of the extending plate 22. The two bending portions 23 are punched upward and then curved rearward from two opposite sides of the front end of the extending plate 22. The extending plate 22 defines a plurality of locating holes 24. The middle shielding plate 20 is integrally molded in the insulating housing 10. The base plate 21 is integrally molded in the base portion 11. The extending plate 22 is integrally molded in the tongue portion 12. The locating holes 24 located at one side of the extending plate 22 are symmetrical to the locating holes 24 located at the other side of the extending plate 22 with respect to center axises of the base plate 21 and the extending plate 22 for fastening the base portion 11 and the middle shielding plate 20.

A front end of the base plate 21 is of a rectangular shape, and a rear end of the base plate 21 is of a rectangular shape. Two opposite sides of the front end of the base plate 21 project beyond two opposite sides of the rear end of the base plate 21. Two opposite sides of the front end of the base plate 21 are defined as two cutting ends 211. Material strips are connected with the cutting ends 211 and are cut from the cutting ends 211. So outer surfaces of the two cutting ends 211 are exposed to the two perforations 116.

The extending plate 22 has a connecting plate 221 extended frontward from a middle of the front end of the base plate 21, and a fixing plate 222 spread outward and then extended frontward from a front end of the connecting plate 221. The connecting plate 221 is molded in a rear end of the tongue portion 12 and a front end of the base portion 11. The fixing plate 222 is molded in the front section 18 of the tongue portion 12. The two bending portions 23 are located at two front corners of the middle shielding plate 20. The two bending portions 23 project beyond a front surface of the extending plate 22.

Each of the bending portions 23 has a rising section 231 slantwise extended frontward and upward from one of the two opposite sides of the front end of the extending plate 22, and a curving section 232 connected with a front end of the rising section 231. The curving section 232 is extended frontward and then curved rearward from the front end of the rising section 231. The curving section 232 includes an upper piece 2321 connected with the rising section 231, a lower piece 2322 opposite to the upper piece 2321, and an arc-shaped bending piece 2323 connected between front ends of the upper piece 2321 and the lower piece 2322. The lower piece 2322 is spaced from the upper piece 2321 to form an interstice 2324 between the lower piece 2322 and the upper piece 2321. The lower piece 2322 and the upper piece 2321 of each of the bending portions 23 have the same structure. The lower piece 2322 and the upper piece 2321 of each of the bending portions 23 are aligned with each other up and down.

A distance between a top surface of the upper piece 2321 and a bottom surface of the lower piece 2322 is greater than a distance between a top surface and a bottom surface of the extending plate 22. A thickness of each of the bending portions 23 is greater than a thickness of the base plate 21 and a thickness of the extending plate 22. A thickness of the curving section 232 of each of the bending portions 23 is greater than the thickness of the base plate 21 and the thickness of the extending plate 22. The upper piece 2321, the lower piece 2322 and the bending piece 2323 are an integrative structure. After the bending portions 23 of the middle shielding plate 20 are stamped, the two bending portions 23 are shown lying narrow U shapes with mouths of the two bending portions 23 facing rearward. Each of the mouths of the bending portions 23 are defined as the interstice 2324.

The extending plate 22 is molded in the tongue portion 12. Two opposite side surfaces of the extending plate 22 are exposed outside from two opposite sides of the main portion 181 of the front section 18 of the tongue portion 12. Outer side surfaces of the two bending portions 23 are exposed outside from two opposite sides of the two fixing portions 182. The front surface of the extending plate 22 is completely molded in the front section 18 of the tongue portion 12. The two bending portions 23 are respectively molded in the two fixing portions 182. The curving section 232 of each of the bending portions 23 is molded in one of the two fixing portions 182. Front ends of two side surfaces of the extending plate 22 and the outer side surfaces of the two bending portions 23 are exposed from two opposite sides of the fixing slot 118. Two side surfaces of the fixing plate 222 of the extending plate 22 are exposed from two opposite sides of the first fixing slot 1181. An outer side surface of the curving section 232 of each of the bending portions 23 is exposed from the second fixing slot 1182.

After a butting connector (not shown) is interconnected with the electrical connector 100, a scraping area between the butting connector and the electrical connector 100 is mostly located at the outer side surfaces of the two bending portions 23, respectively. Specifically, the scraping area between the butting connector and the electrical connector 100 is mostly located at the outer surface of the curving section 232 of each of the bending portions 23, so that scraped plastic of the tongue portion 12 is decreased to improve anti-abrasion performance of the electrical connector 100 in the process of the butting connector being interconnected with the electrical connector 100. So a better electrical conduction characteristic between the butting connector and the electrical connector 100 is ensured.

Referring to FIG. 3 to FIG. 5, the terminals 30 are received in the insulating housing 10. The terminals 30 include a plurality of first terminals 31 and a plurality of second terminals 32. The first terminals 31 are mounted to a top of the insulating housing 10 and the second terminals 32 are mounted to a bottom of the insulating housing 10. The first terminals 31 and the second terminals 32 are stamped by metal. Each of the first terminals 31 has an elongated first contact portion 311, and a first soldering portion 312 extended downward and then bent rearward from a rear end of the first contact portion 311. Each of the second terminals 32 has an elongated second contact portion 321, and a second soldering portion 322 extended downward and then bent rearward from a rear end of the second contact portion 321. The first terminals 31 are located above and without contacting the middle shielding plate 20. The second terminals 32 are located under the middle shielding plate 20 and without contacting the middle shielding plate 20. The first terminals 31 are mounted to the first terminal grooves 112 and arranged transversely. The second terminals 32 are mounted to the second terminal grooves 113 and arranged transversely. The middle shielding plate 20 is located between and spaced from the first terminals 31 and the second terminals 32. So the electrical connector 100 is inserted by a butting connector (not shown) to respectively realize a normal insertion and a reverse insertion.

The first contact portion 311 is exposed to the top surface of the tongue portion 12. The second contact portion 321 is exposed to the bottom surface of the tongue portion 12. The first soldering portion 312 of each of the first terminals 31 projects out of one of the first terminal grooves 112. The second soldering portion 322 of each of the second terminals 32 projects out of one of the second terminal grooves 113. A tail end of the first soldering portion 312 of each of the first terminals 31 and a tail end of the second soldering portion 322 of each of the second terminals 32 are exposed outside from the assembling opening 111.

Referring to FIG. 3, FIG. 4, FIG. 9 and FIG. 10, the inner shielding shell assembly 40 is mounted in the receiving groove 115. The inner shielding shell assembly 40 includes an upper shell 41 and a lower shell 42. The upper shell 41 is received in the receiving groove 115. The upper shell 41 has a first main plate 411. Two opposite sides of the first main plate 411 are bent downward to form two first buckling arms 412. The two first buckling arms 412 are punched outward to form two buckling pieces 413. A rear edge of the first main plate 411 is bent upward to form a first bending plate 414. Two opposite sides of a top edge of the first bending plate 414 are slantwise extended upward and rearward to form two first resilient arms 415. A middle of the top edge of the first bending plate 414 is bent rearward to form a first auxiliary plate 416. A middle of a rear edge of the first auxiliary plate 416 extends downward to form a first locking portion 417. The first main plate 411 is received in a top of the receiving groove 115. The two first buckling arms 412 are received in two opposite sides of the receiving groove 115. The first bending plate 414 abuts against an upper portion of the front surface of the base portion 11. The two first resilient arms 415 of the upper shell 41 are resiliently disposed over the two first recesses 13. The first auxiliary plate 416 is mounted on the top surface of the base portion 11. The first locking portion 417 is locked in the first locking groove 14.

The lower shell 42 is received in the receiving groove 115 and matched with the upper shell 41. The lower shell 42 has a second main plate 421. Two opposite sides of the second main plate 421 are bent upward to form two second buckling arms 422. The two second buckling arms 422 define two buckling holes 423. A rear edge of the second main plate 421 is bent downward to form a second bending plate 424. Two opposite sides of a bottom edge of the second bending plate 424 are slantwise extended downward and rearward to form two second resilient arms 425. A middle of the bottom edge of the second bending plate 424 is bent rearward to form a second auxiliary plate 426. A middle of a rear edge of the second auxiliary plate 426 extends upward to form a second locking portion 427. The second main plate 421 is received in a bottom of the receiving groove 115. The two second buckling arms 422 are received in the two opposite sides of the receiving groove 115. The buckling pieces 413 are buckled in the buckling holes 423. The second bending plate 424 abuts against a lower portion of the front surface of the base portion 11. The two second resilient arms 425 of the lower shell 42 are resiliently disposed under the two second recesses 15. The second auxiliary plate 426 is mounted on the bottom surface of the base portion 11. The second locking portion 427 is locked in the second locking groove 16.

Referring to FIG. 1, FIG. 2, FIG. 3, FIG. 4 and FIG. 9, the outer shielding shell 50 surrounds the insulating housing 10 together with the middle shielding plate 20, the terminals 30 and the inner shielding shell assembly 40. An insertion space 60 is formed between the outer shielding shell 50 and the insulating housing 10. The outer shielding shell 50 has a top plate 51, two lateral plates 52 extended downward from two opposite sides of the top plate 51, a bottom plate 53 connected between front ends of bottoms of the two lateral plates 52, a rear plate 54 connected with rear ends of the top plate 51 and the two lateral plates 52, and an accommodating space 55 is surrounded among the top plate 51, the lateral plates 52, the bottom plate 53 and the rear plate 54. A periphery of the outer shielding shell 50 defines a plurality of soldering feet 56.

Two opposite sides of a rear end of the bottom plate 53 and two opposite sides of the top plate 51 define a plurality of blocking portions 57 projecting into the accommodating space 55. Two opposite sides of a substantial middle of the bottom plate 53 protrude downward to form two protruding blocks 58. The blocking portions 57 are blocked in the first recesses 13 and the second recesses 15. The first resilient arms 415 and the second resilient arms 425 of the inner shielding shell assembly 40 abut against the outer shielding shell 50. The first resilient arms 415 and the second resilient arms 425 respectively abut against the top plate 51 and the bottom plate 53 of the outer shielding shell 50 and received in the first recesses 13 and the second recesses 15. Bottom surfaces of the tail end of the first soldering portion 312 of each of the first terminals 31 and the tail end of the second soldering portion 322 of each of the second terminals 32 are flush with bottom surfaces of the two protruding blocks 58.

As described above, the middle shielding plate 20 is integrally molded in the insulating housing 10, the two bending portions 23 are respectively molded in the two fixing portions 182, the outer side surfaces of the two bending portions 23 are exposed outside from two opposite sides of the two fixing portions 182, the thickness of each of the bending portions 23 is greater than the thickness of the extending plate 22, so after the butting connector is interconnected with the electrical connector 100, the scraping area between the butting connector and the electrical connector 100 is mostly located at the outer side surfaces of the two bending portions 23, so that the scraped plastic of the tongue portion 12 is decreased to improve the anti-abrasion performance of the electrical connector 100 in the process of the butting connector being interconnected with the electrical connector 100. As a result, the better electrical conduction characteristic between the butting connector and the electrical connector 100 is ensured.

What is claimed is:

1. An electrical connector, comprising:

an insulating housing having a base portion, and a tongue portion protruded frontward from a front surface of the base portion, a front section of the tongue portion having a main portion, and two fixing portions protruded outward from two opposite sides of the main portion;

a middle shielding plate integrally molded in the insulating housing, the middle shielding plate having a base plate, an extending plate extended frontward from a front edge of the base plate, and two bending portions formed at two opposite sides of a front end of the extending plate, the extending plate being molded in the tongue portion, two opposite side surfaces of the extending plate being exposed outside from two opposite sides of the main portion of the tongue portion, the two bending portions respectively molded in the two fixing portions, outer side surfaces of the two bending portions being exposed outside from two opposite sides of the two fixing portions, a thickness of each of the bending portions being greater than a thickness of the extending plate; and a plurality of terminals received in the insulating housing.

2. The electrical connector as claimed in claim 1, wherein each of the bending portions has a rising section slantwise extended frontward and upward from one of the two opposite sides of the front end of the extending plate, and a curving section connected with a front end of the rising section.

3. The electrical connector as claimed in claim 2, wherein the curving section includes an upper piece connected with the rising section, a lower piece opposite to the upper piece, and a bending piece connected between front ends of the upper piece and the lower piece, the lower piece is spaced from the upper piece to form an interstice between the lower piece and the upper piece.

4. The electrical connector as claimed in claim 3, wherein a distance between a top surface of the upper piece and a bottom surface of the lower piece is greater than a distance between a top surface and a bottom surface of the extending plate.

5. The electrical connector as claimed in claim 3, wherein the lower piece and the upper piece of each of the bending portions are aligned with each other up and down.

6. The electrical connector as claimed in claim 1, wherein the two bending portions are punched upward and then curved rearward from two opposite sides of the front end of the extending plate.

7. The electrical connector as claimed in claim 1, wherein the two bending portions are shown lying narrow U shapes with mouths of the two bending portions facing rearward.

8. The electrical connector as claimed in claim 1, wherein a periphery of the tongue portion is connected with a ring-shaped blocking rib, the blocking rib is spaced from the front surface of the base portion to form a receiving groove between the blocking rib and the base portion, the electrical connector further includes an inner shielding shell assembly, the inner shielding shell assembly is mounted in the receiving groove.

9. The electrical connector as claimed in claim 8, wherein the inner shielding shell assembly includes an upper shell and a lower shell, the upper shell has a first main plate, two opposite sides of the first main plate are bent downward to form two first buckling arms, the two first buckling arms are punched outward to form two buckling pieces, the lower shell has a second main plate, two opposite sides of the second main plate are bent upward to form two second buckling arms, the two second buckling arms define two buckling holes, the first main plate is received in a top of the receiving groove, the second main plate is received in a bottom of the receiving groove, the first buckling arms and the second buckling arms are received in the two opposite sides of the receiving groove, the buckling pieces are buckled in the buckling holes.

10. The electrical connector as claimed in claim 9, wherein the base portion defines two first recesses penetrating through two opposite sides of a top surface and the front surface of the base portion, the base portion defines two second recesses penetrating through two opposite sides of the bottom surface and the front surface of the base portion, a rear edge of the first main plate is bent upward to form a first bending plate, two opposite sides of a top edge of the first bending plate are slantwise extended upward and rearward to form two first resilient arms, a rear edge of the second main plate is bent downward to form a second bending plate, two opposite sides of a bottom edge of the second bending plate are slantwise extended downward and rearward to form two second resilient arms, the two first resilient arms are resiliently disposed over the two first recesses, the two second resilient arms are resiliently disposed under the two second recesses.

11. The electrical connector as claimed in claim 10, wherein the top surface of the base portion is concaved downward to form a first locking groove located between the two first recesses, the bottom surface of the base portion is concaved upward to form a second locking groove located between the two second recesses, a middle of the top edge of the first bending plate is bent rearward to form a first auxiliary plate, a middle of a rear edge of the first auxiliary plate extends downward to form a first locking portion, a middle of the bottom edge of the second bending plate is bent rearward to form a second auxiliary plate, a middle of a rear edge of the second auxiliary plate extends upward to form a second locking portion, the first locking portion is locked in the first locking groove, the second locking portion is locked in the second locking groove.

12. The electrical connector as claimed in claim 10, further comprising an outer shielding shell surrounding the inner shielding shell assembly, the first resilient arms and the second resilient arms of the inner shielding shell assembly abutting against the outer shielding shell.

13. The electrical connector as claimed in claim 1, further comprising an outer shielding shell, the outer shielding shell surrounding the insulating housing together with the middle shielding plate and the terminals.

* * * * *